US009689401B2

(12) United States Patent
Guillemin et al.

(10) Patent No.: US 9,689,401 B2
(45) Date of Patent: Jun. 27, 2017

(54) RADIAL IMPELLER WITH A RADIALLY FREE BASIC RIM

(71) Applicant: Thermodyn, Le Creusot (FR)

(72) Inventors: Sylvain Guillemin, Saint Remy (FR); Vittorio Michelassi, Munich (DE); Douglas Carl Hofer, Clifton Park, NY (US)

(73) Assignee: Thermodyn, Le Creusot (FR)

( * ) Notice: Subject to any disclaimer, the term of this patent is extended or adjusted under 35 U.S.C. 154(b) by 631 days.

(21) Appl. No.: 13/773,171

(22) Filed: Feb. 21, 2013

(65) Prior Publication Data

US 2013/0216393 A1 Aug. 22, 2013

(30) Foreign Application Priority Data

Feb. 21, 2012 (FR) ..... 12 51542

(51) Int. Cl.

| | |
|---|---|
| ***F04D 29/20*** | (2006.01) |
| ***F01D 5/04*** | (2006.01) |
| ***F01D 5/30*** | (2006.01) |
| ***F01D 5/34*** | (2006.01) |
| ***F04D 29/02*** | (2006.01) |
| ***F04D 29/28*** | (2006.01) |
| ***F04D 29/62*** | (2006.01) |

(52) U.S. Cl.

CPC ..... *F04D 29/20* (2013.01); *F01D 5/04* (2013.01); *F01D 5/3069* (2013.01); *F01D 5/34* (2013.01); *F04D 29/023* (2013.01); *F04D 29/284* (2013.01); *F04D 29/624* (2013.01); *F05D 2230/642* (2013.01)

(58) Field of Classification Search

CPC .... F05D 2230/642; F01D 5/3069; F01D 5/04; F01D 5/34; F04D 29/20; F04D 29/644; F04D 29/023; F04D 29/284; F04D 29/62

USPC ..... 416/182, 186 R, 187, 224 R, 214 A, 416/244 A, 204 R, 198 A

See application file for complete search history.

(56) References Cited

U.S. PATENT DOCUMENTS 1,362,074 A * 12/1920 Baumann ..... F01D 5/021 416/214 A
1,959,220 A * 5/1934 Robinson ..... 416/244 R
(Continued)

FOREIGN PATENT DOCUMENTS

DE 496605 C * 4/1930
DE 496605 C 4/1930

OTHER PUBLICATIONS

U.S. Appl. No. 13/773,171—ProquestTrans—DE499605C—Apr. 1930, Germany, Jaeger.*

(Continued)

*Primary Examiner* — Theodore Stigell
*Assistant Examiner* — Jon Hoffmann
(74) *Attorney, Agent, or Firm* — GE Global Patent Operation

(57) ABSTRACT

An impeller designed to be mounted on a rotary shaft includes: a basic rim provided with blades protruding on one surface of the basic rim, and a hub capable of being coupled to the basic rim and to the rotary shaft. In certain embodiments, the impeller includes an annular plate and the hub, where the annular plate and the basic rim are configured to interact together so as to hold the basic rim axially and to maintain a freedom of radial deformation of the basic rim relative to the hub and to the annular plate.

13 Claims, 8 Drawing Sheets

(56) References Cited

U.S. PATENT DOCUMENTS

| | | | | | |
|---|---|---|---|---|---|
| 2,103,905 | A | * | 12/1937 | Hillner | F01D 5/3046 416/217 |
| 2,390,504 | A | * | 12/1945 | Berger | 415/198.1 |
| 2,921,769 | A | * | 1/1960 | Flader | F01D 5/147 416/222 |
| 3,084,343 | A | * | 4/1963 | Rubio | F01D 5/3046 416/215 |
| 3,165,342 | A | * | 1/1965 | Anderson | F16D 1/08 403/263 |
| 3,362,494 | A | * | 1/1968 | Boehler et al. | 180/128 |
| 3,459,366 | A | * | 8/1969 | Schroeter | 416/204 R |
| 3,826,592 | A | * | 7/1974 | Raboin | F01D 5/3046 416/222 |
| 3,832,091 | A | * | 8/1974 | Hoffman | F04D 29/282 416/184 |
| 4,123,199 | A | | 10/1978 | Shimizu et al. | |
| 4,173,429 | A | * | 11/1979 | Hoffman | F01D 5/025 416/184 |
| 5,191,711 | A | * | 3/1993 | Vickers | B23B 1/00 29/559 |
| 5,425,287 | A | * | 6/1995 | Beattie | 74/574.4 |
| 5,588,803 | A | * | 12/1996 | Vetter et al. | 416/186 R |
| 6,375,412 | B1 | * | 4/2002 | Dial | 415/90 |
| 6,779,964 | B2 | * | 8/2004 | Dial | 415/1 |
| 8,277,190 | B2 | * | 10/2012 | Piersall | F01D 5/3007 416/210 R |

OTHER PUBLICATIONS

EPO Form 1503, FR, Oct. 9, 2012, French Search Report for FR 1251542.

* cited by examiner

RADIAL IMPELLER WITH A RADIALLY FREE BASIC RIM

RELATED APPLICATION

This application claims priority to French application No. FR 1251542, filed Feb. 21, 2012, the entire disclosure of which is incorporated herein by this reference.

The invention relates to rotors with compression blades or impellers, intended for the mechanical compression of a gas and relates more particularly to the fastening of the impellers to a rotary shaft of a compressor.

A compressor impeller conventionally comprises a hub by which the rotor is fastened to the compressor shaft and a basic rim, from which the blades extend radially, and which is connected to the hub.

Usually, a compressor impeller is hot shrink-fitted onto the rotary shaft of the compressor. The tightening is then calculated to be sufficient in all situations in order to absorb, at full speed, all the forces applied to the rotor whether they be aerodynamic, due to the thrust, or to the transmitted torque.

It is known practice to provide mechanical arrangements using flexible mechanical systems by dint of their shape and their thickness notably with respect to the hubs in order to absorb the forces applied to the rotor but, in all cases, the basic rim supporting the blades of the rotor is rigidly fastened to the deformable hub.

In view of the foregoing, the proposal is to alleviate the drawbacks of the impellers according to the prior art by proposing an impeller comprising a basic rim that is free to be deformed radially relative to the hub.

According to one aspect, an impeller is proposed that is designed to be mounted on a rotary shaft comprising a basic rim provided with blades protruding on one face of the basic rim, and an annular hub capable of being coupled to the basic rim and to the rotary shaft.

According to a general feature, the impeller comprises an annular plate and the hub, the plate and the basic rim are configured to interact together so as to hold the basic rim axially and maintain a freedom of radial deformation of the basic rim relative to the hub and to the plate.

The mechanical fastening parts, consisting of the plate and the hub, and the basic rim can therefore have considerable differential expansions. Specifically, since the hub and the plate are assembled to the basic rim so as to maintain a freedom of radial deformation of the basic rim relative to the hub and to the plate, the basic rim can expand radially independently of the expansion of the hub and the plate, that is to say that the expansion of the basic rim can be different from the expansion of the plate and the hub. It is therefore possible to use different materials between the basic rim and the mechanical fastening parts. It is notably possible to use high-performance materials for the basic rim which cannot usually be shrink-fitted to the shaft, while the fastening parts, that is to say the hub and the plate, are made of materials that can be shrink-fitted to the rotary shaft.

Preferably, the basic rim comprises a circular key on its inner perimeter capable of interacting with a first notch made in the hub and a second notch made in the plate, the first and the second notch being placed opposite one another so that the circular key of the basic rim is held in the notches when the hub, the plate and the basic rim are assembled.

The circular key, the first notch and the second notch have dimensions such that, on the one hand, the circular key is held axially without freedom of axial movement and thus to centre the basic rim axially, and, so that, on the other hand, the circular key can move radially in a space defined by the notches notably when the basic rim expands. For this, the radial dimensions of the first and second notches preferably have larger dimensions than the radial dimensions of the circular key, and the axial dimensions of the circular key are equal to the axial space defined by the first and the second notch when the hub and the plate are assembled.

Advantageously, the circular key may comprise two outer O-rings respectively placed on either side of the basic rim on the outer radial surface of the circular key, and two inner O-rings respectively placed on either side of the basic rim on the inner radial surface of the circular key.

The two inner O-rings make it possible to provide a radial centering of the basic rim when cold, that is to say while the impeller is stationary, by virtue of its inner diameter. The two outer O-rings make it possible to maintain the centering of the basic rim when the impeller is made to rotate causing an expansion of the basic rim that is greater than the expansion of the fastening parts, that is to say the plate and the hub. The radial centering is maintained by virtue of the natural deformation of the inner and outer O-rings when the rotary shaft builds up speed of rotation. At full rotation speed, the centering of the basic rim is maintained by virtue of the outer diameter of the circular key.

Instead of two inner O-rings placed on either side of the basic rim on the inner surface of the circular key, the circular key may comprise a single inner O-ring placed on the inner surface of the circular key in a centred manner. However, the use of two inner O-rings allows better balancing.

The impeller may advantageously comprise radial guiding means capable of limiting the friction between the basic rim and the hub, and between the basic rim and the plate during the radial deformation of the basic rim.

The friction between the basic rim and the hub may cause damage to the mechanical fastening parts and/or to the basic rim. Specifically, the friction may cause cracks to appear in the basic rim and/or in the plate and/or the hub.

Preferably, the radial guiding means comprise, on each of the axial faces of the basic rim, at least one circular groove placed in the circular key, the circular grooves each comprising an O-ring or a rolling means.

The circular key therefore comprises at least one groove facing the first notch made in the hub and at least one groove facing the second notch made in the plate. The rolling means, such as balls, rolls, or rollers for example, or the O-rings are inserted into the circular grooves and have dimensions such that, on the axial faces of the basic rim, the circular key is not directly in contact with the plate on one side and with the hub on the other side.

In a variant, the second notch made in the plate comprises an oblique outer radial contact surface, the outer radial surface of the key comprises a matching oblique portion opposite the oblique outer radial contact surface of the plate, and the plate is assembled to the hub so as to be able to be deformed and to separate from the hub over a distal portion during the radial deformation of the basic rim.

Thus, when the basic rim expands radially relative to the hub with the increase in the rotation speed, the circular key exerts a radial force on the plate and notably on the oblique outer radial contact surface. The force thus applied by the circular key on the oblique outer radial contact surface causes, by virtue of the flexibility of the plate and notably of its distal portion, the plate to separate from the hub and hence to increase the space between the two notches. The bearing point between the outer radial surface of the circular key and the oblique outer radial contact surface of the plate then moves making possible at the same time the radial expansion of the rim and the application of a retaining axial force by the distal portion of the plate on the circular key towards the hub, which makes it possible to maintain the centering of the basic rim.

Advantageously, the plate may comprise centering means and the hub may comprise matching centering means capable of interacting with the centering means.

The centering means and the matching centering means thus make it possible to assemble the hub and the plate in a radially centred manner, that is to say relative to the rotation axis of the impeller, and thus to obtain a uniform axial retaining force applied to the basic rim that allows the axial centering of the basic rim.

The centering means may advantageously comprise a centering ring fastened to the plate and comprising a tooth gear facing the hub, and the matching centering means comprise a matching centering ring fastened to the hub and comprising a matching tooth gear facing the plate capable of interacting with the tooth gear of the centering ring.

The centering ring and the matching centering ring may correspond to an axial gear pair such as a tooth gear of the Hirth® type.

In a variant, the centering means may comprise a conical, protruding proximal portion of the plate facing the hub and having as its axis the rotary shaft, and the matching centering means comprise, in the hub, a conical recess facing the plate having the rotary shaft as its axis, the conical protruding portion and the conical recess being capable of interacting during the assembly of the plate to the hub.

If the hub is shrink-fitted or incorporated into the rotary shaft and the plate remains free relative to the rotary shaft, the transmission of the torque between the shaft and the plate may be achieved by friction between the conical protruding portion of the plate and the conical recess of the hub, or else by the use of a pin or of a key between the hub and the plate.

Advantageously, the hub may be placed on a first shaft portion and the plate may be placed on a second shaft portion, the first shaft portion and the second shaft portion being secured by fastening means so as to secure the hub and the plate.

The first shaft portion may therefore comprise a threaded orifice along the rotation axis of the shaft on the end-fitting facing the second shaft portion, and the second shaft portion may comprise, on the end-fitting facing the first shaft portion, a screw of which the thread matches the thread of the orifice in the first shaft portion.

In order to secure the plate and the hub pair, the impeller may also comprise a bolted fastening flange capable of securing the plate to the hub. The fastening flange may for example pass through the plate and be threaded in the hub so as to fix a screw in the hub through the plate, with the screw head pressing on a face of the plate.

Preferably, the impeller comprises an end-piece coupled to the basic rim via the blades, the end-piece and the basic rim having an identical weight.

The equal weights of the end-piece and the basic rim make it possible to obtain a virtually symmetrical centrifugal force on either side of the connection with the blades. The stresses in the basic rim are therefore reduced and this promotes the virtually radial deformation of the basic rim that is locked only axially onto the shaft by virtue of the plate and the hub.

The hub may be shrink-fitted or incorporated over at least a portion of the rotary shaft of the compressor.

The plate may also be shrink-fitted or incorporated over at least a portion of the rotary shaft of the compressor.

According to another aspect, in one embodiment, a motor-compressor unit is proposed comprising a motor, a compressor and a common casing sealed against the gas to be compressed in which the motor and the compressor are installed, the compressor comprising at least one impeller as defined above.

Other advantages and features of the invention will become evident on examination of the detailed description of embodiments that are in no way limiting, and of the appended drawings in which:

FIG. 1 is a schematic view showing the general architecture of a motor-compressor unit furnished with impellers according to the invention;

FIGS. 2*a* and 2*b* represent respectively an exploded view and an assembled view of an impeller according to a first embodiment;

FIG. 3 represents an impeller according to a second embodiment;

FIGS. 4*a* and 4*b* represent an impeller according to a third embodiment;

Figure 1:
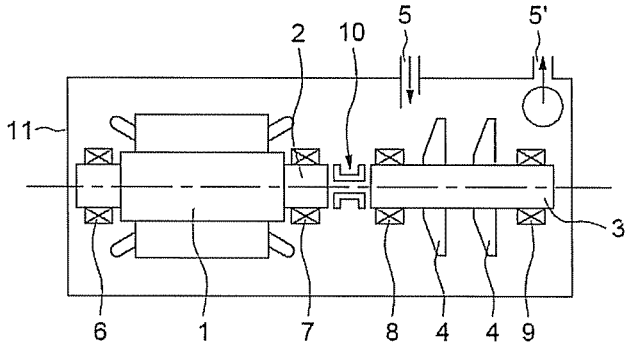
FIG. 1 shows an example of a compressor unit provided with impellers made according to the invention.

It will be noted however that the application illustrated in FIG. 1 is in no way limiting, the invention relating, in general, to the mechanical compression of a gas such that there is no departure from the context of the invention when the impellers are mounted on other types of compressors.

The motor-compressor unit illustrated in FIG. 1 comprises essentially a motor 1, consisting for example of a variable-speed electric motor rotating a rotor 2, itself driving at identical speed a rotary shaft 3 on which an impeller 4 is mounted.

The motor-compressor unit in this instance comprises a single compression stage consisting of the radial impellers 4 which draw in a gas delivered from an inlet duct 5 in order to cause an increase in its pressure and deliver it at the outlet 5'.

In the exemplary embodiment shown, the rotor 2 is supported by two end bearings 6 and 7. This is also the case for the rotary shaft 3 which is also supported by two end bearings 8 and 9. Therefore, according to this arrangement, the rotor 2 and the rotary shaft 3 are connected via a flexible coupling 10. The rotor and the rotary shaft could equally be connected via a fixed coupling. In this case, one of the bearings, such as 7 and 8, could be omitted.

Finally, the assembly, i.e. the motor 1 and the compression stage, is placed in a common casing 11 sealed against the gas handled by the compressor. In other words, the motor 1 is in this instance at the suction pressure of the motor-compressor unit.

Figure 2A:
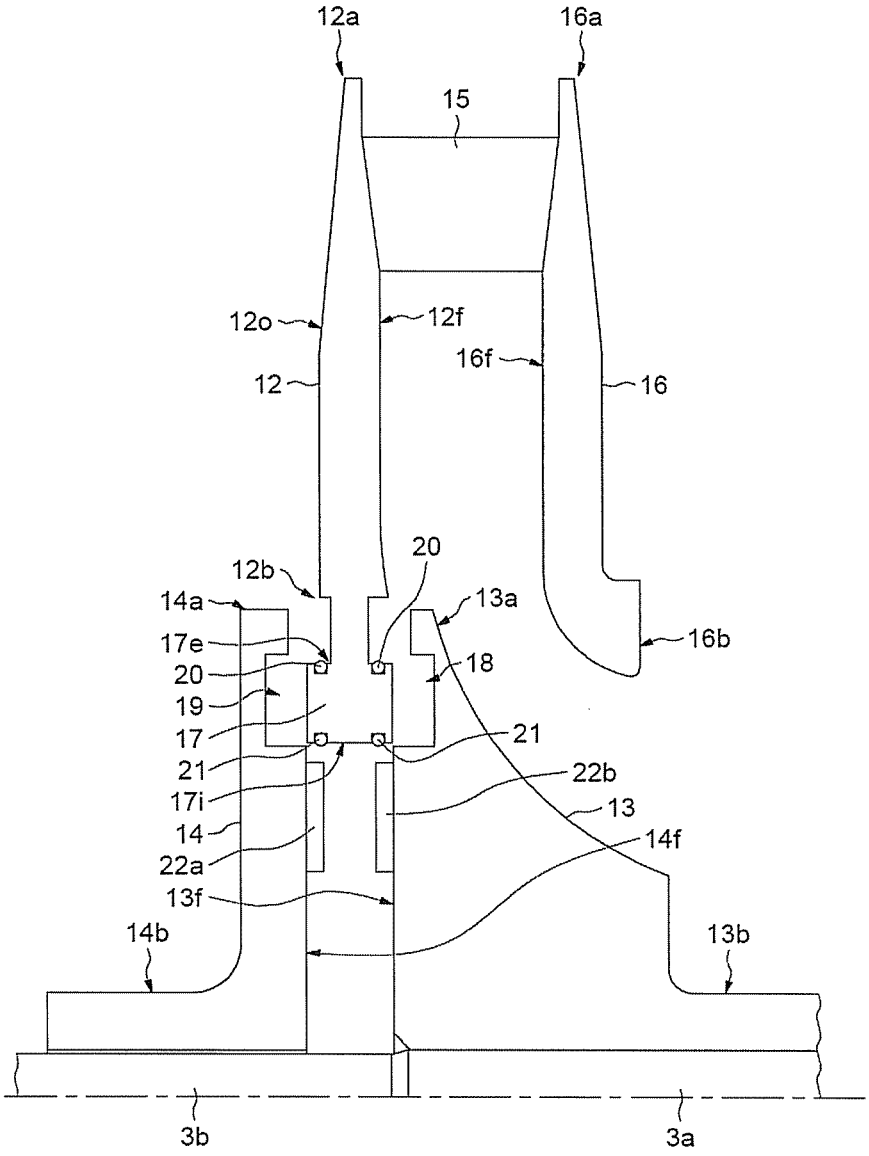
Figure 2B:
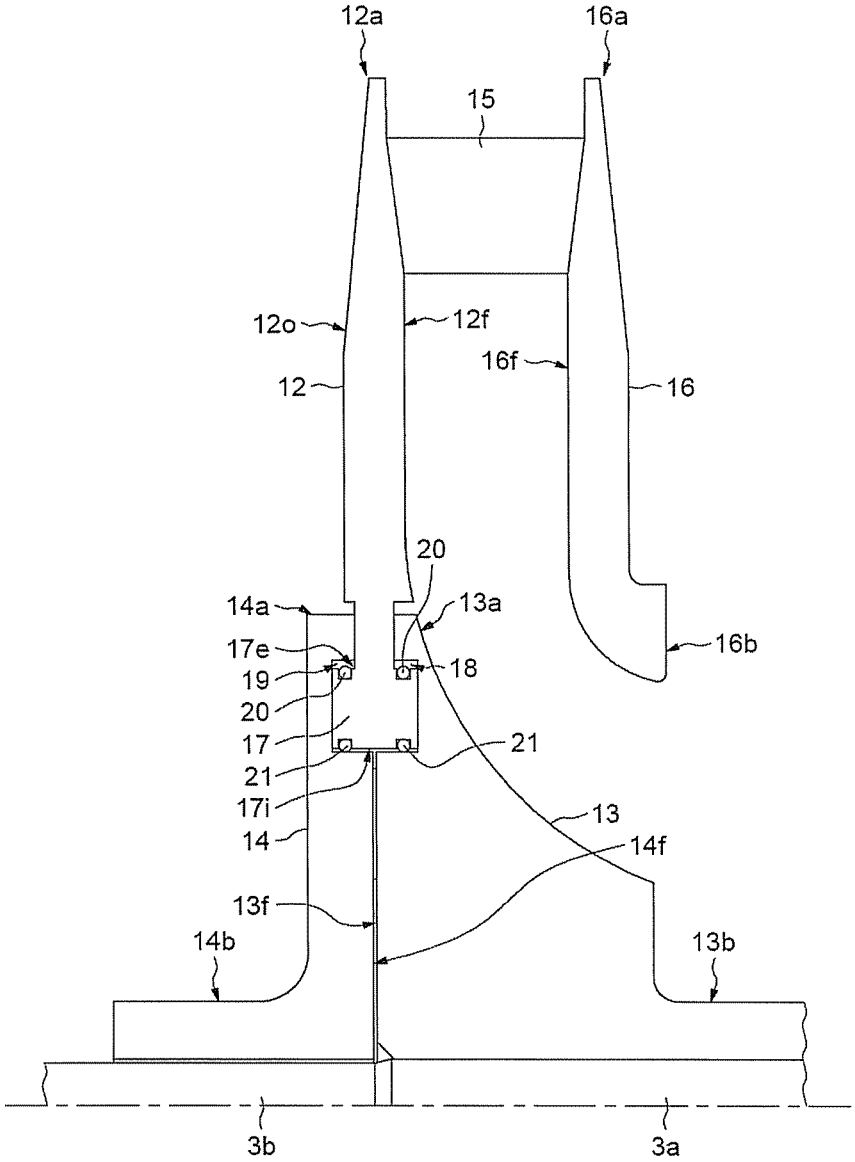

FIGS. 2*a* and 2*b* show respectively an exploded view and an assembled view of a first example of impellers, according to one embodiment of the invention that can be installed in the compressor unit of FIG. 1.

The impeller 4 comprises three distinct portions: a basic rim 12, a hub 13, a plate 14.

The basic rim 12 comprises a distal portion 12*a* and a proximal portion 12*b* relative to its rotation axis indistinguishable from the rotation axis of the rotary shaft 3. The basic rim 12 extends in a plane orthogonal to its rotation axis and comprises a first face 12*f* and an opposite face 12*o*. The basic rim 12 comprises, mainly on its distal portion 12*a*, blades 15 protruding on the first face 12*f* of the basic rim 12 facing an end-piece 16.

The end-piece 16 comprises a distal portion 16*a* and a proximal portion 16*b* relative to its rotation axis indistinguishable from the rotation axis of the rotary shaft 3. The distal portion 16*a* of the end-piece 16 is placed parallel to the distal portion 12*a* of the basic rim 12 and is coupled to the blades 15 on a face 16*f* facing the basic rim 12.

The end-piece 16 and the basic rim 12 have a similar weight so as to obtain a centrifugal force that is virtually symmetrical on either side of the connection with the blades 15. The stresses in the basic rim 12 are therefore reduced and a virtually radial deformation of the basic rim 12 is thus promoted.

The basic rim 12 comprises, on its proximal portion 12*b*, a circular key 17. The circular key 17 is notably placed along the inner perimeter of the basic rim 12. The circular key 17 comprises, in this example, a section of generally square shape.

The hub 13 has an annular shape of which the rotation axis is indistinguishable from the axis of the rotary shaft 3. The hub 13 has a bearing face 13*f* orthogonal to the axis of the rotary shaft 3 and designed to be facing the plate 14, a distal portion 13*a* and a proximal portion 13*b* relative to its rotation axis.

The plate 14 also has an annular shape of which the rotation axis is indistinguishable from the axis of the rotary shaft 3. The plate comprises a bearing face 14*f* orthogonal to the axis of the rotary shaft 3 and designed to be facing the hub 13, a distal portion 14*a* and a proximal portion 14*b* relative to its rotation axis.

The hub 13 comprises, on the distal portion 13*a* of its bearing face 13*f*, a first notch 18 capable of receiving in part the circular key 17. The plate comprises, on the distal portion 14*a* of its bearing face 14*f*, a second notch 19 capable of receiving in part the circular key 17. The first notch 18 and the second notch 19 are made so as to be facing one another with identical dimensions so that the second notch 19 is symmetrical with the first notch 18 relative to the axis defined by the bearing faces 13*f* and 14*f* when the hub and the plate are in contact.

It is possible for notches 18 and 19 not to be symmetrical relative to the circular key 17 so long as the junction between the circular key 17 and the rest of the basic rim 12 is centred relative to the basic rim 12. The notches 18 and 19 may therefore comprise matching shapes so as to axially retain the circular key 17 and to define a passage for the junction between the circular key 17 and the rest of the basic rim 12, the junction being centred relative to the circular key 17 and the rest of the basic rim 12.

In this embodiment, the notches 18 and 19 have dimensions so as to retain the circular key 17 axially, that is to say to be resting with the circular key 17 in a direction parallel to the rotation axis of the basic rim 12.

The circular key 17 may comprise a section with a shape different from the square shape, such as for example a hexagonal, octagonal shape or any other shape capable of interacting with the first and second notches 18 and 19.

On the other hand, the radial dimensions of the notches 18 and 19 are greater than the dimension of the circular key 17 in a direction orthogonal to the rotation axis of the basic rim 12. This is so as to maintain a freedom of radial movement of the circular key 17 notably when the basic rim 12 is deformed with the speed of rotation.

The radial centering when cold of the basic rim 12, that is to say when the impeller 4 is stationary or at low speed, is achieved by virtue of the inner diameter of the circular key 17, while the centering of the basic rim 12 at full speed is achieved by virtue of the outer diameter of the circular key, after the basic rim has expanded.

The circular key 17 comprises an inner radial surface 17*i* oriented towards the rotation axis of the basic rim and an outer radial surface 17*e* opposite to the inner radial surface 17*i*. The circular key 17 comprises, on its outer radial surface 17*e*, two outer O-rings 20. The two outer O-rings 20 are respectively placed on either side of the basic rim 12, that is to say one on the side of the first face 12*f* of the basic rim 12 and the other on the opposite side 12*o*.

In the same way, the circular key 17 comprises, on its inner radial surface 17*i*, two inner O-rings 21 respectively placed on either side of the basic rim 12, that is to say symmetrically on either side of the plane in which the basic rim 12 extends.

Thus, on start-up, the basic rim 12 is centred radially by virtue of the inner diameter of the circular key 17. In rotation, the basic rim 12 can be deformed more rapidly than the hub 13 and the plate 14 which constitute the fastening elements, this can be done with light retaining stresses due to the friction forces in the radial guiding between the circular key 17 and the hub, on the one hand, and between the circular key 17 and the plate 14, on the other hand. In this transitory phase, the centering is maintained by virtue of the two outer O-rings 20 and of the two inner O-rings 21 deforming naturally. When the operating speed is achieved, the maximum radial inflation of the basic rim 12 is achieved, the plate and the hub are configured to allow the basic rim to be centred by virtue of the outer diameter of the circular key 17.

When the speed reduces, the basic rim 12 reproduces the opposite deformation until it is again centred at low speed.

The hub 13 is incorporated into a first shaft portion 4*a* and the plate 14 is incorporated into a second shaft portion 3*b*. The hub 13 and the plate 14 could also be shrink-fitted respectively onto the first and the second shaft portions 3*a* and 3*b*. The assembly of the hub 13 with the plate 14 is carried out by screwing of the second shaft portion 3*b* into the first shaft portion 3*a*, the first shaft portion 3*a* comprising a threaded orifice along its rotation axis on an end-fitting facing the second shaft portion 3*b*, and the second shaft portion 3*b* comprising an end-fitting facing the first shaft portion 3*a* having a screw pitch matching the threading of the orifice in the first shaft portion 3*a*.

As a variant, it would also be possible to use a bolted fastening flange in order to secure the plate to the hub, as will be described with reference to FIG. 3.

The centering of the hub 13 with the plate 14 is carried out with the aid of an axial gear pair, for example with the aid of a Hirth® tooth gear system. The plate 14 comprises a centering ring 22*a* fastened to the bearing face 14*f* of the plate 14. The hub 13 comprises a matching centering ring 22*b* fixed to the bearing face 13*f* of the hub 13. When the hub 13 and the plate 14 are assembled, the centering ring 21*a* interacts with the matching centering ring 21*b* for the radial centering, and thus making the first and second notches 18 and 19 match radially.

Figure 3:
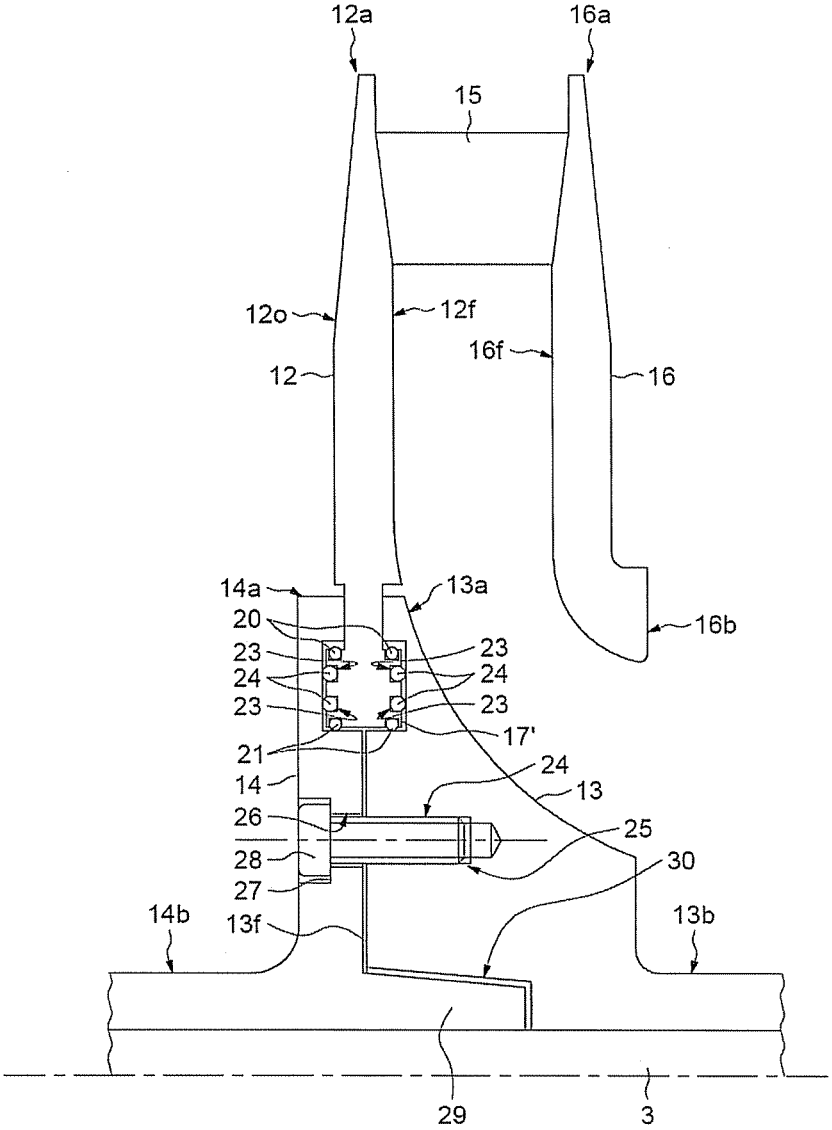

FIG. 3 illustrates a second example of an impeller 4 according to one embodiment of the invention. The elements bearing the same references as in FIGS. 2*a* and 2*b* are identical.

In this embodiment, the circular key 17' comprises radial guiding means making it possible to prevent the friction between the circular key 17' and the hub 13 on the one hand, and between the circular key 17' and the plate 14 on the other hand. The radial guiding means, comprise, on the first face 12*f* and the opposite face 12*o* of the basic rim 12 at least one circular groove 23 placed in the circular key 17'. Each circular groove 23 comprises rolling balls 24 making it possible to separate the circular key 17' from the hub 13 on the one hand, and the circular key 17' from the plate 14 on the other hand.

This embodiment also differs from that shown in FIGS. 2*a* and 2*b* by virtue of the centering means and the means for fastening the hub 13 to the plate 14.

The impeller 4 illustrated in FIG. 3 comprises, as fastening means, a bolted fastening flange 24 capable of securing the plate 14 to the hub 13. The fastening flange 24 comprises a blind threaded hole 25 in the hub 13, the opening of the threaded hole 25 being placed on the bearing face 13*f* of the hub 13. The fastening flange 24 also comprises a through-orifice 26 made in the plate 14 facing the threaded hole 25. The through-orifice 26 comprises an abutment 27 so that a screw 28 resting on the abutment 27 can keep the plate 14 tight on the hub 13.

In order to centre the plate 14 and the hub 13, the plate 14 comprises a protruding portion 29 on its proximal portion 14*b*. The protruding portion extends towards the hub 13 with a conical shape with a decreasing section. The hub 13 comprises a matching recess 13 made in its proximal portion 13*b* with a conical shape capable of interacting with the protruding portion 29 of the plate 14.

With such centering means, it would be possible for the impeller 4 to comprise no bolted fastening flange 24, the transmission of the torque between the hub 13 and the plate 14 being able to be carried out by friction between the protruding portion 29 and the surfaces of the hub 13 delimiting the recess 30, or else by fitting a pin or a key between the hub 13 and the plate 14.

Figure 4A:
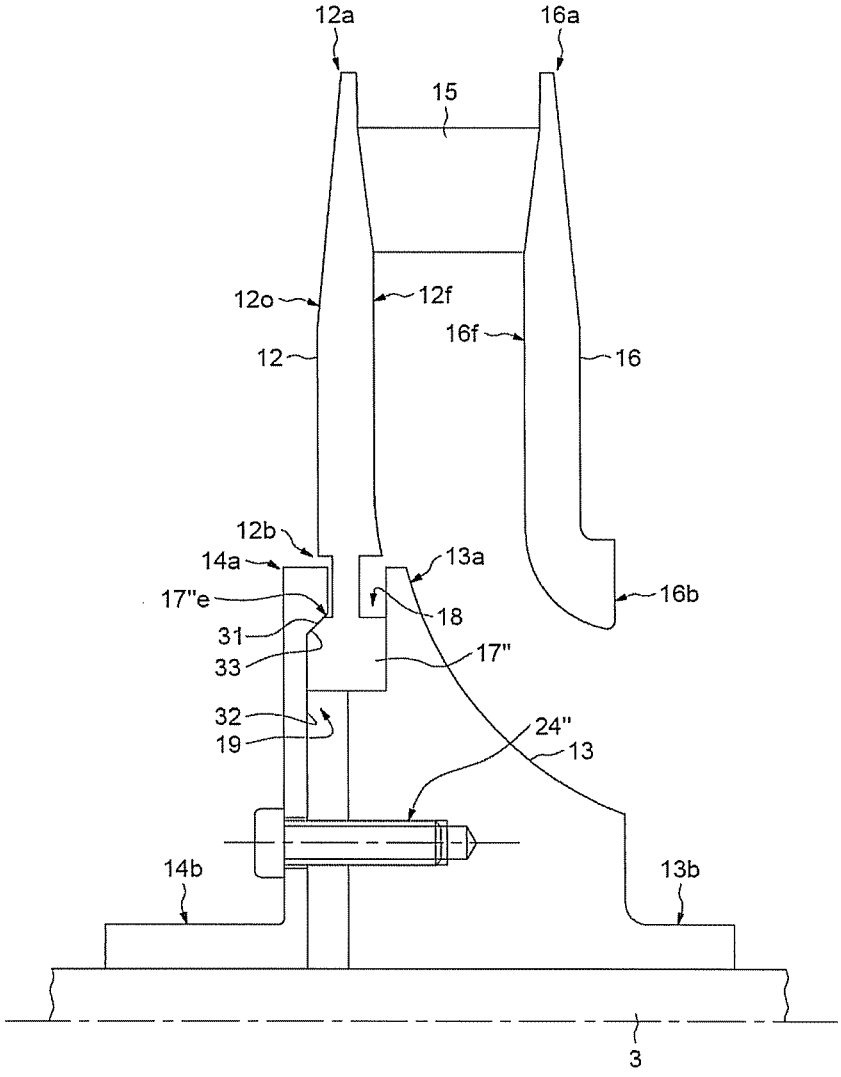
Figure 4B:
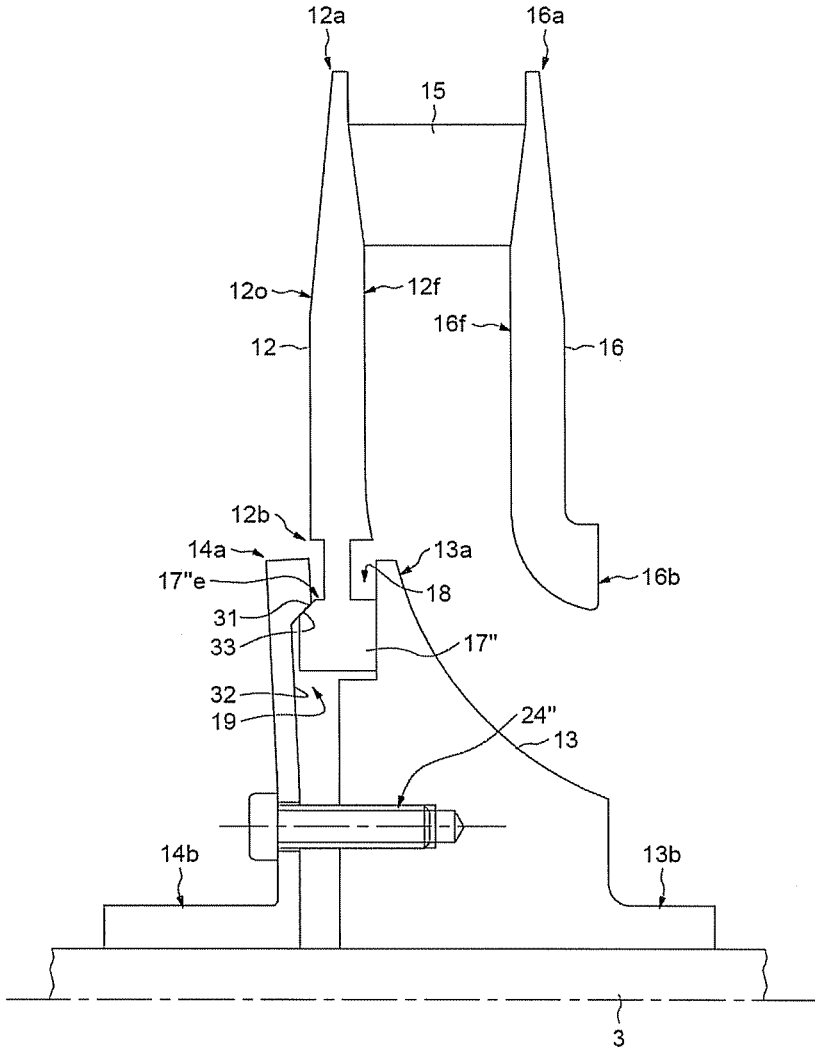

FIGS. 4*a* and 4*b* show a third example of an impeller 4 according to one embodiment of the invention. The elements bearing the same references as in FIGS. 2*a* and 2*b* are identical. FIG. 4*a* shows the third example of an impeller 4 when stationary or at low rotation speed, while FIG. 4*b* shows the third example of an impeller 4 at high rotation speed.

In this embodiment, the second notch 19 made in the plate 14 comprises an oblique outer radial contact surface 31 so as to form an obtuse angle with the face of the notch 32 facing the hub 13.

Correspondingly, the outer radial surface 17"*e* of the circular key 17" comprises an oblique portion facing and parallel to the oblique outer radial contact surface 31 of the plate 14. As a variant, the circular key 17" may comprise a section of hexagonal shape, one of the faces of the circular key 17" being parallel to and facing the outer radial contact surface 17"*e*.

The plate 14 is secured to the hub 13 with the aid of a fastening flange 24". The fastening flange 24" is mounted on the plate 14 in the proximal portion 14*b* so that the plate 14 can be deformed and separate from the hub 13 over a distal portion 14*a* during the radial deformation of the basic rim 12.

Figure 5:
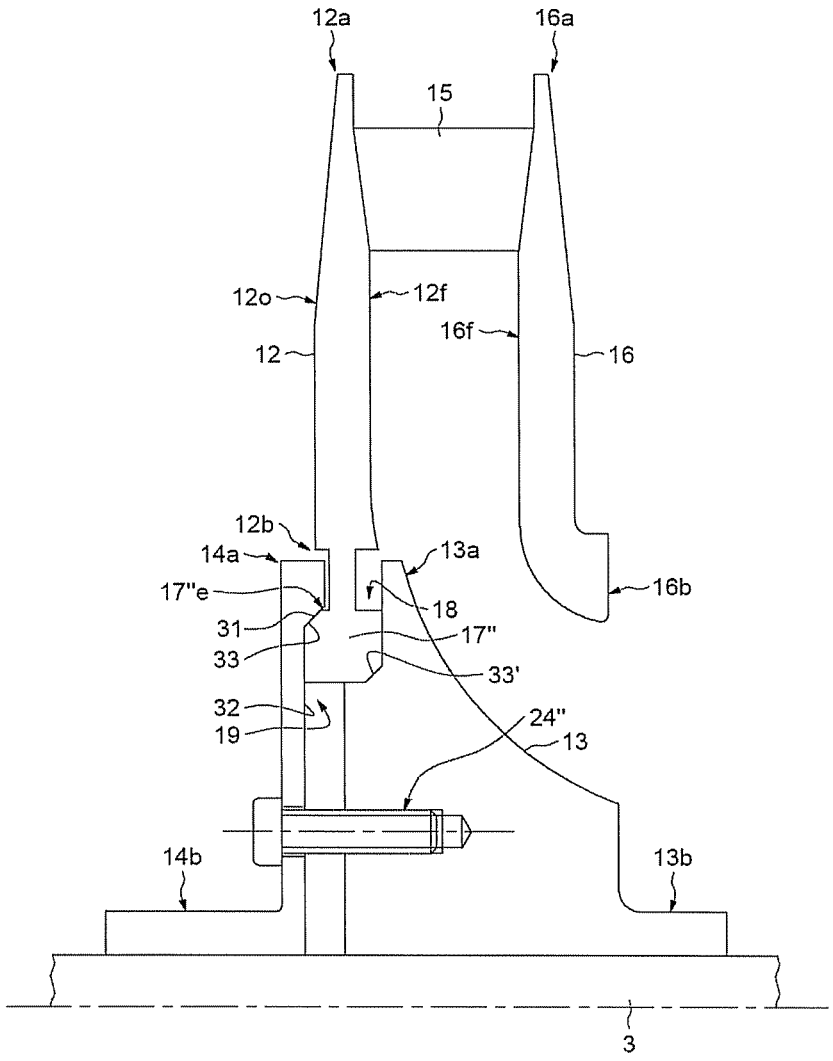
FIG. 5 illustrates a variant of the embodiment of FIGS. 4*a* and 4*b*.

In one embodiment, it would also be possible to provide another oblique surface made in the hub, in the location of the angle formed by the notch 18 and an oblique matching surface 31 in radial contact in the circular key 17" (FIG. 5).

As illustrated in FIG. 4*b*, when the impeller 4 is set to rotate in order to achieve its maximum speed, the basic rim 12 may thus be deformed radially, the circular key 17" moving slightly away radially from its rotation axis by virtue of the deformation of the plate 14, and more precisely from the distal portion 14*a* of the plate, the oblique portion of the outer radial surface 17"*e* of the circular key 17" sliding along the oblique outer radial contact surface 31.

The invention is not limited to these three various embodiments. It also comprises all the possible combinations between these embodiments.

The invention thus makes it possible to provide an impeller with a basic rim having a freedom of radial deformation, and a possibility of using materials for the basic rim which cannot be used for the fastening parts.

Figure 6:
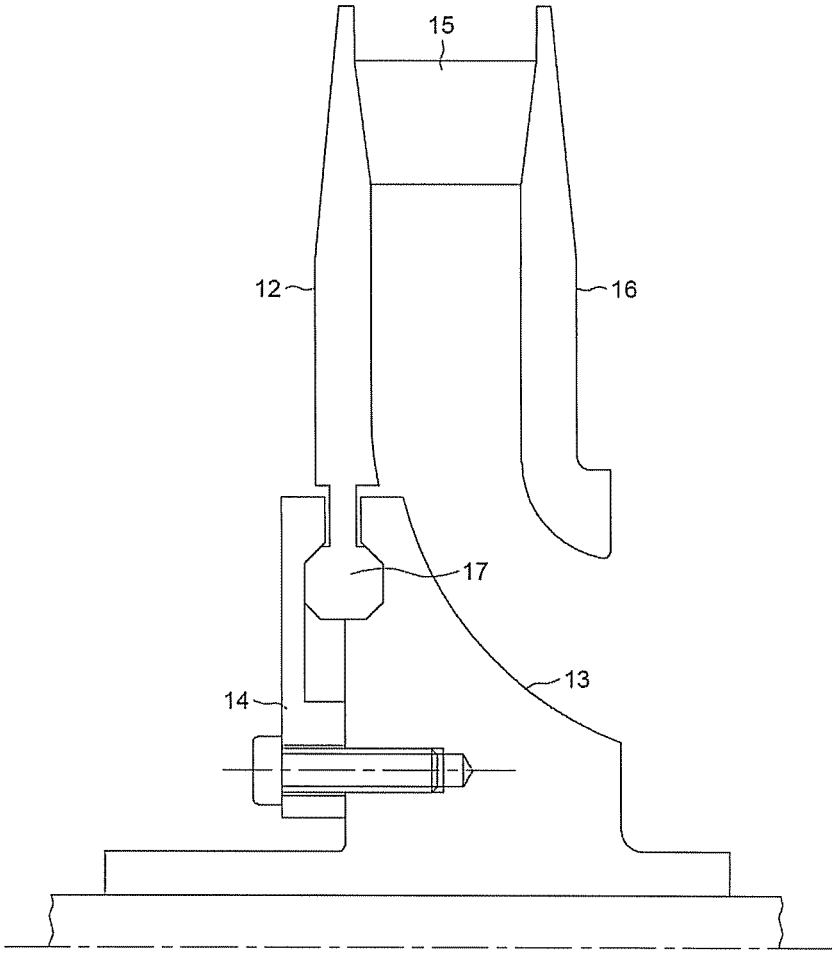
FIG. 6 illustrates an impeller according to another embodiment.

Finally, referring now to FIG. 6, in which elements identical to the elements of FIGS. 2*a* and 2*b* bear the same reference numbers, according to another exemplary embodiment, the plate 14 can be attached by bolting to the hub 13 and thus constitute an element that is distinct from the rotary shaft 3.

In this FIG. 6, the bolting system used to fasten the plate 14 to the hub 13 has not been shown. It will be noted however that it would be possible, with advantage, to use a bolted fastening flange similar to that described with reference to FIG. 3.

Note furthermore that, in this embodiment, the circular key 17 is furnished with a set of radial contact surfaces interacting with matching oblique surfaces made on the hub, on the one hand, and on the plate, on the other hand.

The invention claimed is:

1. An impeller designed to be mounted on a rotary shaft of a compressor, comprising:

a basic rim provided with axial blades protruding on one radial face of the basic rim;

an annular hub capable of being coupled to the basic rim and to the rotary shaft; and an annular plate, wherein the annular hub, the annular plate, and the basic rim are configured to interact together so as to hold the basic rim axially and to maintain a freedom of radial deformation of the basic rim relative to the annular hub and to the annular plate, the basic rim being held only by the annular plate and the annular hub, wherein the basic rim comprises a circular key on its inner perimeter capable of interacting with a first notch made in the annular hub and a second notch made in the annular plate, the first and second notches being placed opposite one another so that the circular key of the basic rim is held in the notches when the annular hub, the annular plate and the basic rim are assembled, and wherein the impeller further comprises radial guiding means capable of limiting friction between the basic rim and the annular hub, and between the basic rim and the annular plate during the radial deformation of the basic rim, the radial guiding means comprising, on each face of the basic rim, at least one circular groove placed in the circular key, the circular grooves each comprising an O-ring or a rolling means.

2. The impeller according to claim 1, in which the circular key comprises two outer O-rings respectively placed on either side of the basic rim on an outer radial surface of the circular key, and two inner O-rings respectively placed on either side of the basic rim on an inner radial surface of the circular key.

3. The impeller according to claim 1, in which the second notch made in the annular plate comprises an oblique outer radial contact surface, an outer radial surface of the circular key comprises a matching oblique portion opposite the oblique outer radial contact surface of the annular plate, and the annular plate is assembled to the annular hub so as to be able to be deformed and to separate from the annular hub over a distal portion during the radial deformation of the basic rim.

4. The impeller according to claim 1, in which the annular plate comprises centering means, and the annular hub comprises matching centering means capable of interacting with the centering means.

5. The impeller according to claim 4, in which the centering means comprise a centering ring fastened to the annular plate and comprising a tooth gear facing the annular hub, and the matching centering means comprise a matching centering ring fastened to the annular hub and comprising a matching tooth gear facing the annular plate capable of interacting with the tooth gear of the centering ring.

6. The impeller according to claim 4, in which the centering means comprise a conical, protruding proximal portion of the annular plate facing the annular hub and having as its axis the rotary shaft, and the matching centering means comprise, in the annular hub, a conical recess facing the annular plate having the rotary shaft as its axis, the conical protruding portion and the conical recess being capable of interacting during the assembly of the annular plate to the annular hub.

7. The impeller according to claim 1, in which the annular hub is placed on a first shaft portion and the annular plate is placed on a second shaft portion, the first shaft portion and the second shaft portion being secured by fastening means so as to secure the annular hub and the annular plate.

8. The impeller according to claim 1, further comprising a bolted fastening flange capable of securing the annular plate to the annular hub.

9. The impeller according to of claim 1, further comprising an end-piece coupled to the basic rim via the blades, the end-piece and the basic rim having an identical weight.

10. The impeller according to claim 1, in which the annular hub is shrink-fitted or incorporated over at least a portion of the rotary shaft of the compressor.

11. The impeller according to claim 1, in which the annular plate is shrink-fitted or incorporated over at least a portion of the rotary shaft of the compressor.

12. A compressor comprising at least one impeller according to claim 1.

13. The impeller according to claim 1, wherein radial dimensions of the notches are greater than a dimension of the circular key in a direction orthogonal to a rotation axis of the basic rim.

* * * * *